US008307919B2

(12) United States Patent
Hall et al.

(10) Patent No.: US 8,307,919 B2
(45) **Date of Patent: *Nov. 13, 2012**

(54) CLUTCH FOR A JACK ELEMENT

(75) Inventors: David R. Hall, Provo, UT (US); David Lundgreen, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/004,795

(22) Filed: Jan. 11, 2011

(65) Prior Publication Data

US 2011/0303461 A1 Dec. 15, 2011

Related U.S. Application Data

(63) Continuation of application No. 11/757,928, filed on Jun. 4, 2007, now Pat. No. 7,866,416.

(51) Int. Cl.
*E21B 4/02* (2006.01)
*E21B 4/06* (2006.01)

(52) U.S. Cl. ..... 175/298; 175/293; 175/296

(58) Field of Classification Search ..... 175/57, 175/293, 296, 298, 414
See application file for complete search history.

(56) References Cited

U.S. PATENT DOCUMENTS 465,103 A 12/1891 Wegner
616,118 A 12/1898 Kuhne
923,513 A 6/1909 Hardsocg
946,060 A 1/1910 Looker
1,116,154 A 11/1914 Stowers
1,183,630 A 5/1916 Bryson
1,189,560 A 7/1916 Gondos
1,360,908 A 11/1920 Everson
1,372,257 A 3/1921 Swisher
1,387,733 A 8/1921 Midgett
1,460,671 A 7/1923 Hebsacker
1,544,757 A 7/1925 Hufford
1,746,455 A 2/1930 Woodruff et al.
1,746,456 A 2/1930 Allington
1,821,474 A 9/1931 Mercer
1,836,638 A 12/1931 Wright et al.
1,879,177 A 9/1932 Gault
2,054,255 A 9/1936 Howard
2,064,255 A 12/1936 Garfield
2,196,940 A 4/1940 Potts
2,218,130 A 10/1940 Court
2,227,233 A 12/1940 Scott/Noble et al.

(Continued)

OTHER PUBLICATIONS

International Search Report and Written Opinion for PCT/US07/64544, dated Aug. 5, 2008.

(Continued)

*Primary Examiner* — Brad Harcourt
(74) *Attorney, Agent, or Firm* — Brinks Hofer Gilson & Lione

(57) ABSTRACT

A downhole tool string, comprising a tool string bore and a drill bit located at the bottom of the tool string. The drill bit comprises a body intermediate a shank and a working surface. The working surface may comprise a substantially coaxial rotationally isolated jack element with a portion of the jack element extending out of an opening formed in the working surface to engage a subterranean formation. The tool string may comprise a driving mechanism adapted to rotate the jack. The clutch assembly disposed within the tool string bore may comprise a first end in communication with the jack element and second end in communication with the driving mechanism.

20 Claims, 6 Drawing Sheets

U.S. PATENT DOCUMENTS

| | | | | |
|---|---|---|---|---|
| 2,300,016 | A | | 10/1942 | Scott et al. |
| 2,320,136 | A | | 5/1943 | Kammerer |
| 2,345,024 | A | | 3/1944 | Bannister |
| 2,371,248 | A | | 3/1945 | McNamara |
| 2,466,991 | A | | 4/1949 | Kammerer |
| 2,498,192 | A | | 2/1950 | Wright |
| 2,540,464 | A | | 2/1951 | Stokes |
| 2,545,036 | A | | 3/1951 | Kammerer |
| 2,575,173 | A | | 11/1951 | Johnson |
| 2,619,325 | A | | 11/1952 | Arutunoff |
| 2,626,780 | A | | 1/1953 | Ortloff |
| 2,643,860 | A | | 6/1953 | Koch |
| 2,725,215 | A | | 11/1955 | MacNeir |
| 2,735,653 | A | | 2/1956 | Bielstein |
| 2,755,071 | A | | 7/1956 | Kammerer |
| 2,776,819 | A | | 1/1957 | Brown |
| 2,819,041 | A | | 1/1958 | Beckham |
| 2,819,043 | A | | 1/1958 | Henderson |
| 2,838,284 | A | | 6/1958 | Austin |
| 2,873,093 | A | | 2/1959 | Hildebrandt |
| 2,877,984 | A | | 3/1959 | Causey |
| 2,894,722 | A | | 7/1959 | Buttolph |
| 2,901,223 | A | | 8/1959 | Scott |
| 2,942,850 | A | | 6/1960 | Heath |
| 2,963,102 | A | | 12/1960 | Smith |
| 2,998,085 | A | | 8/1961 | Dulaney |
| 3,036,645 | A | | 5/1962 | Rowley |
| 3,055,443 | A | | 9/1962 | Edwards |
| 3,058,532 | A | | 10/1962 | Alder |
| 3,075,592 | A | | 1/1963 | Overly et al. |
| 3,077,936 | A | | 2/1963 | Arutunoff |
| 3,135,341 | A | | 6/1964 | Ritter |
| 3,139,147 | A | | 6/1964 | Hays et al. |
| 3,163,243 | A | | 12/1964 | Cleary |
| 3,216,514 | A | | 11/1965 | Nelson |
| 3,251,424 | A | | 5/1966 | Brooks |
| 3,294,186 | A | | 12/1966 | Buell |
| 3,301,339 | A | | 1/1967 | Pennebaker, Jr. |
| 3,303,899 | A | | 2/1967 | Jones, Jr. et al. |
| 3,336,988 | A | | 8/1967 | Jones, Jr. |
| 3,379,264 | A | | 4/1968 | Cox |
| 3,429,390 | A | | 2/1969 | Bennett |
| 3,433,331 | A | | 3/1969 | Heyberger |
| 3,455,158 | A | | 7/1969 | Richter, Jr. et al. |
| 3,493,165 | A | | 2/1970 | Schonfeld |
| 3,583,504 | A | | 6/1971 | Aalund |
| 3,635,296 | A | | 1/1972 | Lebourg |
| 3,700,049 | A | * | 10/1972 | Tiraspolsky et al. ..... 175/50 |
| 3,732,143 | A | | 5/1973 | Joosse |
| 3,765,493 | A | | 10/1973 | Rosar et al. |
| 3,807,512 | A | | 4/1974 | Pogonowski et al. |
| 3,815,692 | A | | 6/1974 | Varley |
| 3,821,993 | A | | 7/1974 | Kniff |
| 3,899,033 | A | | 8/1975 | Van Huisen |
| 3,955,635 | A | | 5/1976 | Skidmore |
| 3,960,223 | A | | 6/1976 | Kleine |
| 3,978,931 | A | | 9/1976 | Sudnishnikov et al. |
| 4,081,042 | A | | 3/1978 | Johnson |
| 4,096,917 | A | | 6/1978 | Harris |
| 4,106,577 | A | | 8/1978 | Summers |
| 4,165,790 | A | | 8/1979 | Emmerich |
| 4,176,723 | A | | 12/1979 | Arceneaux |
| 4,253,533 | A | | 3/1981 | Baker |
| 4,262,758 | A | | 4/1981 | Evans |
| 4,280,573 | A | | 7/1981 | Sudnishnikov |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker et al. |
| 4,445,580 | A | | 5/1984 | Sahley |
| 4,448,269 | A | | 5/1984 | Ishikawa |
| 4,478,296 | A | | 10/1984 | Richman, Jr. |
| 4,499,795 | A | | 2/1985 | Radtke |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,583,592 | A | | 4/1986 | Gazda et al. |
| 4,592,432 | A | | 6/1986 | Williams et al. |
| 4,597,454 | A | | 7/1986 | Schoeffler |
| 4,612,987 | A | | 9/1986 | Cheek |
| 4,624,306 | A | | 11/1986 | Traver et al. |
| 4,637,479 | A | | 1/1987 | Leising |
| 4,640,374 | A | | 2/1987 | Dennis |
| 4,679,637 | A | | 7/1987 | Cherrington |
| 4,683,781 | A | | 8/1987 | Kar et al. |
| 4,732,223 | A | | 3/1988 | Schoeffler |
| 4,775,017 | A | | 10/1988 | Forrest et al. |
| 4,819,745 | A | | 4/1989 | Walter |
| 4,830,122 | A | | 5/1989 | Walter |
| 4,836,301 | A | | 6/1989 | Van Dongen et al. |
| 4,852,672 | A | | 8/1989 | Behrens |
| 4,889,017 | A | | 12/1989 | Fuller |
| 4,907,665 | A | | 3/1990 | Kar et al. |
| 4,962,822 | A | | 10/1990 | Pascale |
| 4,974,688 | A | | 12/1990 | Helton |
| 4,981,184 | A | | 1/1991 | Knowlton |
| 4,991,667 | A | | 2/1991 | Wilkes et al. |
| 5,009,273 | A | | 4/1991 | Grabinski |
| 5,027,914 | A | | 7/1991 | Wilson |
| 5,038,873 | A | | 8/1991 | Jurgens |
| 5,052,503 | A | | 10/1991 | Lof |
| 5,088,568 | A | | 2/1992 | Simuni |
| 5,094,304 | A | | 3/1992 | Briggs |
| 5,103,919 | A | | 4/1992 | Warren et al. |
| 5,119,892 | A | | 6/1992 | Clegg |
| 5,135,060 | A | | 8/1992 | Ide |
| 5,141,063 | A | | 8/1992 | Quesenbury |
| 5,148,875 | A | | 9/1992 | Karlsson et al. |
| 5,163,520 | A | | 11/1992 | Gibson et al. |
| 5,176,212 | A | | 1/1993 | Tandberg |
| 5,186,268 | A | | 2/1993 | Clegg |
| 5,222,566 | A | | 6/1993 | Taylor |
| 5,255,749 | A | | 10/1993 | Bumpurs |
| 5,259,469 | A | | 11/1993 | Stjernstrom |
| 5,265,682 | A | | 11/1993 | Russell |
| 5,311,953 | A | | 5/1994 | Walker |
| 5,314,030 | A | | 5/1994 | Peterson et al. |
| 5,361,859 | A | | 11/1994 | Tibbitts |
| 5,388,649 | A | | 2/1995 | Ilomaki |
| 5,410,303 | A | | 4/1995 | Comeau |
| 5,415,030 | A | | 5/1995 | Jogi et al. |
| 5,417,292 | A | | 5/1995 | Polakoff |
| 5,423,389 | A | | 6/1995 | Warren |
| 5,475,309 | A | | 12/1995 | Hong et al. |
| 5,507,357 | A | | 4/1996 | Hult |
| 5,553,678 | A | | 9/1996 | Barr et al. |
| 5,560,440 | A | | 10/1996 | Tibbitts |
| 5,568,838 | A | | 10/1996 | Struthers |
| 5,642,782 | A | | 7/1997 | Grimshaw |
| 5,655,614 | A | | 8/1997 | Azar |
| 5,678,644 | A | | 10/1997 | Fielder |
| 5,720,355 | A | | 2/1998 | Lamine et al. |
| 5,732,784 | A | | 3/1998 | Nelson |
| 5,758,731 | A | | 6/1998 | Zollinger |
| 5,778,991 | A | | 7/1998 | Runquist et al. |
| 5,794,728 | A | | 8/1998 | Palmberg |
| 5,806,611 | A | | 9/1998 | Van Den Steen |
| 5,833,021 | A | | 11/1998 | Mensa-Wilmot |
| 5,864,058 | A | | 1/1999 | Chen |
| 5,896,938 | A | | 4/1999 | Money |
| 5,901,113 | A | | 5/1999 | Masak |
| 5,904,444 | A | | 5/1999 | Kabeuchi et al. |
| 5,924,499 | A | | 7/1999 | Birchak et al. |
| 5,947,215 | A | | 9/1999 | Lundell |
| 5,950,743 | A | | 9/1999 | Cox |
| 5,957,223 | A | | 9/1999 | Doster |
| 5,957,225 | A | | 9/1999 | Sinor |
| 5,967,247 | A | | 10/1999 | Pessier |
| 5,979,571 | A | | 11/1999 | Scott et al. |
| 5,992,547 | A | | 11/1999 | Caraway |
| 5,992,548 | A | | 11/1999 | Silva |
| 6,021,859 | A | | 2/2000 | Tibbitts |
| 6,039,131 | A | | 3/2000 | Beaton |
| 6,047,239 | A | | 4/2000 | Berger et al. |

6,050,350 A 4/2000 Morris et al.
6,089,332 A 7/2000 Barr et al.
6,092,610 A 7/2000 Kosmala et al.
6,131,675 A 10/2000 Anderson
6,150,822 A 11/2000 Hong et al.
6,186,251 B1 2/2001 Butcher
6,202,761 B1 3/2001 Forney
6,213,225 B1 4/2001 Chen
6,213,226 B1 4/2001 Eppink
6,223,824 B1 5/2001 Moyes
6,269,893 B1 8/2001 Beaton
6,296,069 B1 10/2001 Lamine et al.
6,298,930 B1 10/2001 Sinor
6,321,858 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,439,326 B1 8/2002 Huang et al.
6,443,249 B2 9/2002 Beuershausen
6,450,269 B1 9/2002 Wentworth
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,510,906 B1 1/2003 Richert
6,513,606 B1 2/2003 Krueger
6,533,050 B2 3/2003 Molloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Botnan
6,622,803 B2 9/2003 Harvey
6,668,949 B1 12/2003 Rives
6,670,880 B1 12/2003 Hall et al.
6,729,420 B2 5/2004 Mensa-Wilmot et al.
6,732,817 B2 5/2004 Dewey
6,749,031 B2 6/2004 Klemm
6,789,635 B2 9/2004 Wentworth et al.
6,814,162 B2 11/2004 Moran et al.
6,822,579 B2 11/2004 Goswami
6,880,648 B2 4/2005 Edscer
6,913,095 B2 7/2005 Krueger
6,929,076 B2 8/2005 Fanuel et al.
6,948,572 B2 9/2005 Hay et al.
6,953,096 B2 10/2005 Gledhill
6,994,175 B2 2/2006 Egerstrom
7,013,994 B2 3/2006 Eddison
7,073,610 B2 7/2006 Susman
7,198,119 B1 4/2007 Hall et al.
7,225,886 B1 6/2007 Hall
7,270,196 B2 9/2007 Hall
7,287,609 B2 * 10/2007 Runia et al. ..... 175/257
7,328,755 B2 2/2008 Hall et al.
7,337,858 B2 3/2008 Hall et al.
7,360,610 B2 4/2008 Hall et al.
7,367,397 B2 5/2008 Clemens et al.
7,398,837 B2 7/2008 Hall et al.
7,419,016 B2 9/2008 Hall et al.
7,419,018 B2 9/2008 Hall
7,424,922 B2 9/2008 Hall et al.
7,426,968 B2 9/2008 Hall et al.
7,481,281 B2 1/2009 Schuaf
7,484,576 B2 2/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 7/2009 Hall et al.
7,600,586 B2 10/2009 Hall et al.
7,617,886 B2 11/2009 Hall et al.
7,624,824 B2 12/2009 Hall et al.
7,641,003 B2 1/2010 Hall et al.
7,866,416 B2 * 1/2011 Hall et al. ..... 175/293
2001/0054515 A1 12/2001 Eddison et al.
2002/0050359 A1 5/2002 Eddison
2003/0213621 A1 11/2003 Britten
2004/0222024 A1 11/2004 Edscer
2004/0238221 A1 12/2004 Runia
2004/0256155 A1 12/2004 Kriesels
2007/0079988 A1 4/2007 Konschuh et al.
2007/0079991 A1 * 4/2007 Cooley et al. ..... 175/57
2007/0151732 A1 7/2007 Clemens et al.

OTHER PUBLICATIONS

International Preliminary Report on Patentability, International Search Report and Written Opinion of the International, dated Mar. 5, 2007.

International Preliminary Report on Patentability and Written Opinion of the International Searching Authority for PCT/US06/43125 and the International Search Report, dated Jun. 4, 2007.

* cited by examiner

CLUTCH FOR A JACK ELEMENT

PRIORITY CLAIM

This application is a continuation of U.S. patent application Ser. No. 11/757,928 filed on Jun. 4, 2007, which is now U.S. Pat. No. 7,866,416 that issued on Jan. 11, 2011, the disclosure of which is incorporated in its entirety by this reference.

BACKGROUND OF THE INVENTION

This invention relates to drill bits, specifically drill bit assemblies for use in oil, gas, geothermal, and horizontal drilling. To direct the tool string steering systems, instrumentation has been incorporated into the tool string, typically in the bottomhole assembly.

U.S. Pat. No. 5,642,782 which is herein incorporated by reference for all that it contains, discloses a clutch for providing a rotatable connection between the downhole end of a tubing string and a tubing anchor. The connector device initially prevents relative rotation between tubular subs and then permitting relative rotation.

U.S. Pat. No. 4,732,223 which is herein incorporated by reference for all that it contains, discloses a ball activated clutch assembly that upon activation locks a drilling sub to a fixed angular orientation.

BRIEF SUMMARY OF THE INVENTION

A downhole tool string comprises a bore and a drill bit located at the bottom of the tool string. The drill bit comprises a body intermediate a shank and a working surface. The working surface may comprise a substantially coaxial rotationally isolated jack element with a portion of the jack element extending out of an opening formed in the working surface to engage a subterranean formation. The tool string may comprise a driving mechanism adapted to rotate the jack element. The clutch assembly disposed within the tool string bore may comprise a first end in communication with the jack element and second end in communication with the driving mechanism.

The tool string generally comprises a driving mechanism that may be in communication with the jack. The driving mechanism is generally a turbine, an electric motor, a hydraulic motor, or a combination thereof. Also, within the tool string there may be a clutch assembly adapted to engage the jack element. The clutch assembly may be in mechanical or hydraulic communication with the jack element, the driving mechanism or both. Preferably, the clutch assembly is within a housing that allows fluid to pass through it. Rotation of the driving mechanism is generally caused by the passing fluid. The housing may be adapted to move vertically along the jack. The clutch assembly may comprise an outer coupler that may be rotated counter or with the drill bit. This outer coupler may be adapted to move at various speeds compared to the drill bit. Electronic components may be rotationally fixed to the jack element and may include sensors, gyros, magnometers, acoustic sensors, piezoelectric devices, magnetostrictive devices, MEMS gyros, or combinations thereof. The tool string may comprise an accelerometer that is generally in communication with the jack element.

In some embodiments the first end of the clutch assembly may comprise various engaging geometries such as a flat geometry, a cone geometry, an irregular geometry, a geometry with at least one recess, a geometry with at least one protrusion, or combinations thereof. These different types of geometries may facilitate the engagement and rotation of the jack element. The jack element may also be in communication with a linear actuator. In another embodiment the clutch assembly may comprise a telescoping end that may be adapted to be in communication with the jack element. The telescoping end may move linearly by a hydraulic piston, an electric motor, or a combination thereof.

In another aspect of the invention, a method comprising the steps of providing a tool string bore and a drill bit located at the bottom of the tool string. The drill bit may comprise a body intermediate a shank and a working surface. The working surface may comprise a substantially coaxial rotationally isolated jack element with a portion of the jack element extending out of an opening formed in the working surface to engage a subterranean formation. The clutch assembly disposed within the tool string bore may comprise a first end in communication with the jack element and a second end in communication with the driving mechanism. The method further comprises a step for activating the driving mechanism. The method further comprises a step for altering a rotational speed of the jack element by positioning the first end of the clutch assembly adjacent the jack element by activating a linear actuator while the driving mechanism is in operation.

DETAILED DESCRIPTION OF THE INVENTION AND THE PREFERRED EMBODIMENT

Figure 1:
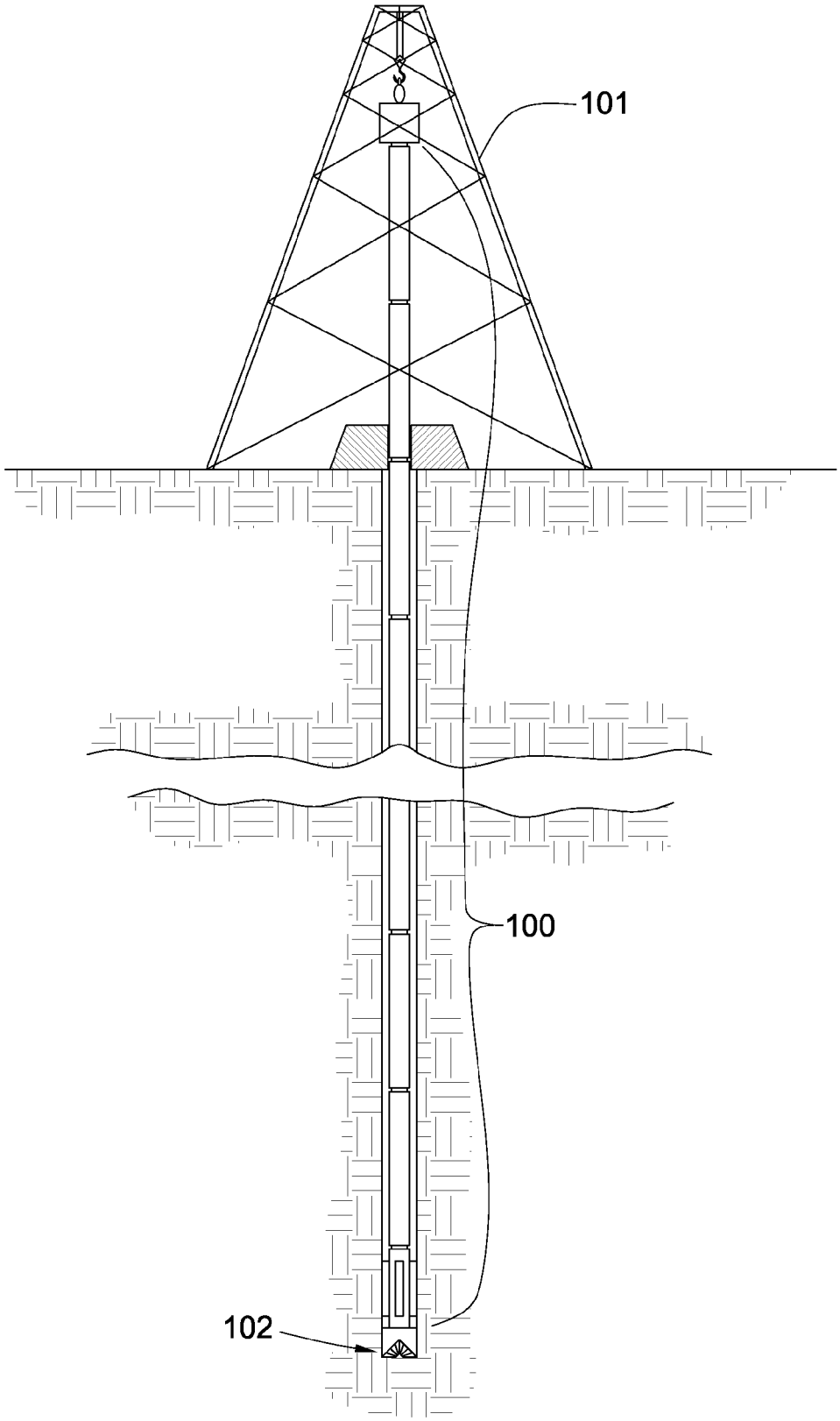
FIG. 1 is an orthogonal diagram of an embodiment of a derrick attached to a tool string comprising a drill bit.

FIG. 1 is an orthogonal diagram of a derrick 101 attached to a tool string 100 comprising a drill bit 102 located at the bottom of a bore hole. The tool string 100 may be made of rigid drill pipe, drill collars, heavy weight pipe, jars, and/or subs. As the drill bit 102 rotates downhole the tool string 100 advances farther into the earth due to the weight on the drill bit 102 and a cutting action of the drill bit 102.

Figure 2:
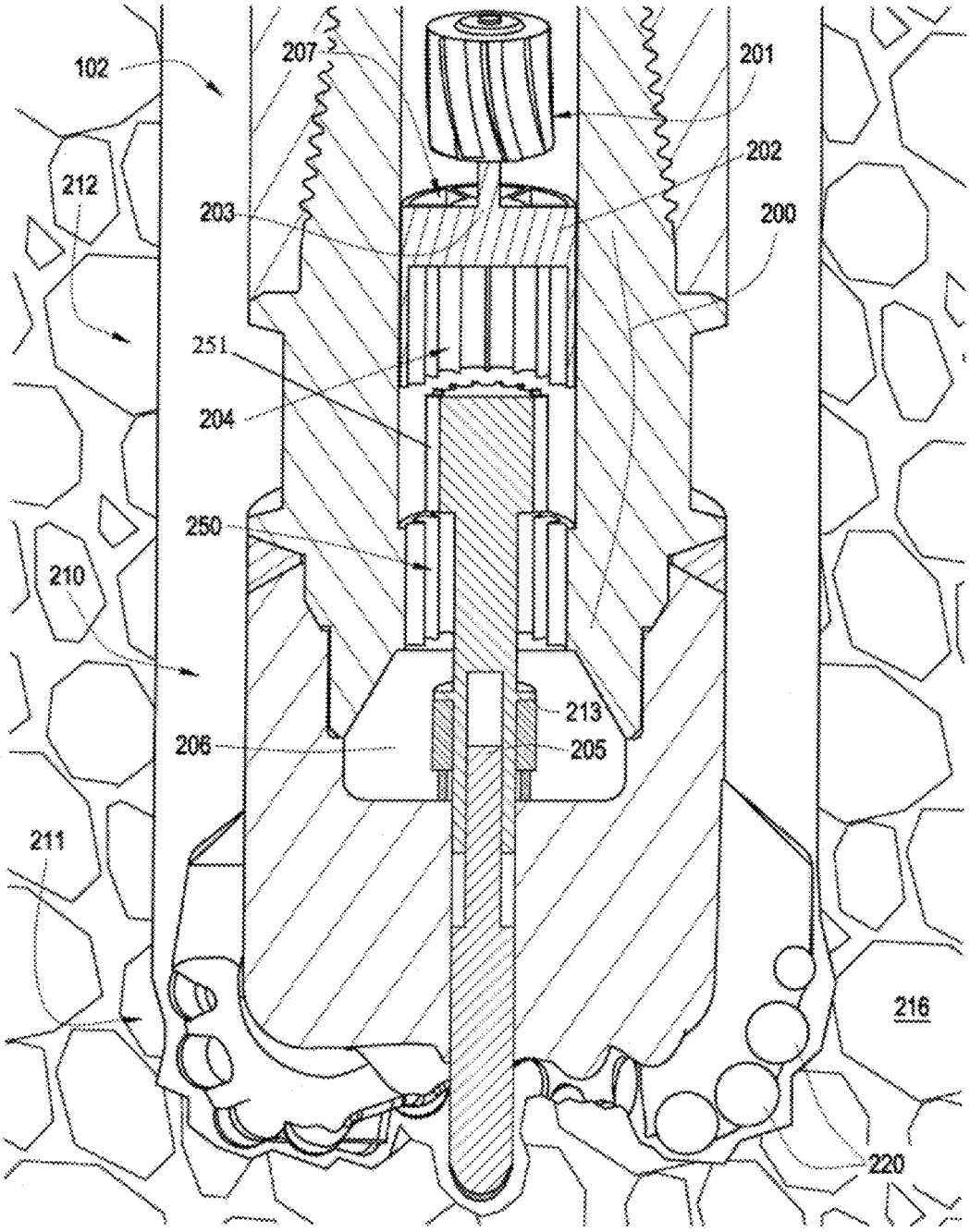
FIG. 2 is a cross-sectional diagram of an embodiment of a drill bit comprising a clutch assembly.

FIG. 2 is a cross-sectional diagram of a drill bit 102 comprising a clutch assembly 200. The drill bit 102 may comprise a body 210 intermediate a shank 212 and working surface 211 having cutters 220. The drill bit 102 may comprise two parts welded together. The shank 212 is attached to the tool string 100. A jack element 205 is incorporated into the drill bit 102 such that a distal end of the jack element 205 is adapted to protrude out of the working surface 211 and contact the formation 216. The jack element 205 may be used for steering and or controlling the weight loaded to the drill bit 102.

A driving mechanism 201, such as a turbine as shown in FIG. 2, may be in communication with the clutch assembly 200 which may comprise a housing 202. The housing 202 may have openings 207 that allow fluid to pass through the clutch assembly 200. The clutch assembly 200 may be placed in the tool string 100 in a portion of the bore formed by the drill bit, or the clutch assembly 200 may be located farther up the tool string. The clutch assembly 200 may comprise a first end 203 in communication with the driving mechanism 201. The driving mechanism 201 may be driven by the drilling mud which may rotate a portion of the clutch assembly, such as the housing 202 as shown in FIG. 2. The clutch assembly 200 may comprise an outer coupler 204 attached to the housing 202 which rotates with the housing. The outer coupler may be adapted to engage and disengage with an inner coupler 251 connected to a jack element 205. The jack element 205 may be in communication with a linear actuator 206 through a flange 213 formed along its length. As the linear actuator 206 expands it may push the flange 213, and therefore the inner coupler 251 attached to the jack element 205, in and out of engagement with the housing 202 of the clutch assembly 200. The outer coupler 204 or the inner coupler 251 may also be adapted to move axially independent of the drill bit 102 and/or the bore of the tool string by a linear actuator. A clutch disk may be used to engage and disengage from the jack element 205. As the driving mechanism 201 is engaged the clutch disk may engage the jack element 205.

Torque from the driving mechanism 201 may be transferred to the jack element 205 by hydraulic shear first and then in some embodiments they become mechanically locked. In some embodiments, the torque may be transmitted by shear as the inner coupler and the outer coupler come into proximity with one another. It is believed that the amount of torque transmitted through shear is dependent at least in part on the distance between the outer and inner couplers, the viscosity of the drilling mud, the volume of the drilling mud, the velocity of the drilling mud and/or combinations thereof. Thus the amount of torque transmitted from the driving mechanism 201 to the jack element 205 may be modified at different stages in the drilling process. Embodiments that transmit torque through hydraulic shear may gain the advantage of reduced wear due to less mechanical contact between the couplers.

In the embodiment shown in FIG. 2, a second outer coupler 250 is rigidly attached to the bore of the tool string. In this embodiment, the driving mechanism 201 is a tophole drive, downhole motor, a Kelly, or a downhole mud motor adapted to rotate the entire tool string. The linear actuator 206 is adapted to position the inner coupler 251 of the jack element 205 with either outer couplers or to position the inner coupler 251 in between the outer couplers. In other situations where it may be desirable to lock the rotation of the jack element 205 with the rotation of the tool string 100, such as when it is desirable to drill in a straight trajectory, the inner coupler 251 may be positioned such that the inner coupler 251 and the second outer coupler 250 interlock. In embodiments, where it may be desirable to rotate the jack independent of the tool string, such as in embodiments where the jack is counter rotated to steer the tool string, the linear actuator 206 may position the inner coupler 251 such that it interacts with the outer coupler fixed to the housing of the clutch assembly.

Figure 5:
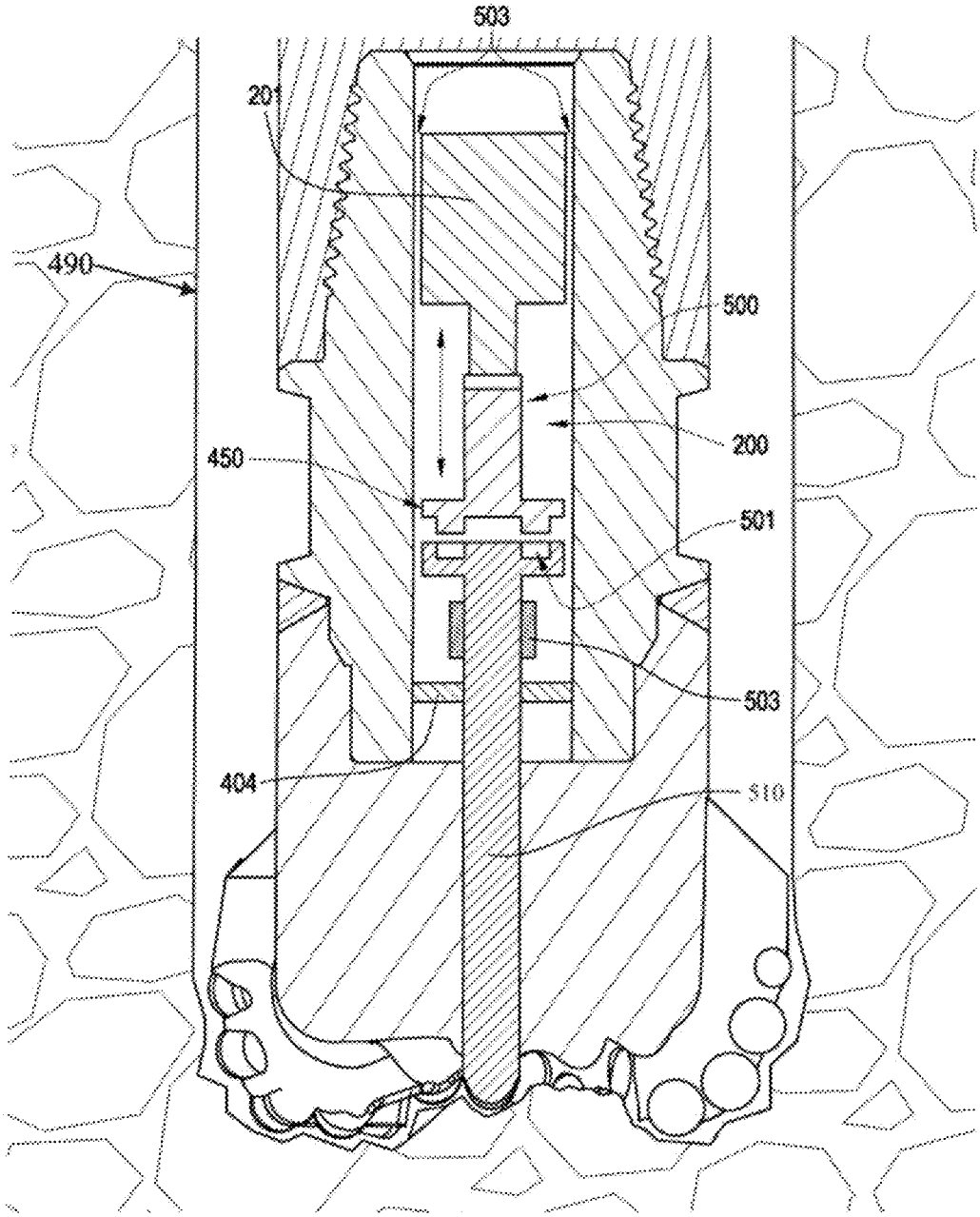
FIG. 5 is a cross-sectional diagram of an embodiment of a drill bit comprising another embodiment of a clutch assembly.

In some embodiments, sensitive instrumentation 503 such as gyroscopes, accelerometers, direction and inclination packages, and/or combinations thereof may be fixed to the jack element 205 such as shown in FIG. 5. It is believed that in some downhole situations the drill bit may be lifted off of the bottom of the bore hole while drilling mud is flowing through the tool string bore such that the formation is not in contact with a distal end of the jack element 205; and thereby no resistance from the formation is provided to control the rotational velocity of the jack element 205. In such situations it may be desirable for the inner coupler 251 of the jack element 205 to be separated from a fluid driving mechanism located in the bore, since it may cause the jack element 205 to rotate fast enough to overload the sensitive instrumentation.

In some embodiments, the inner coupler 251 may comprise a polygonal geometry to which is substantially complementary to the inside geometry to the clutch housing.

Another benefit of a clutch assembly that engages with hydraulic shear is that the responsiveness of the jack element may be controlled. If there are sudden changes in the rpm of the driving mechanism, a sudden change in the rpm of the jack element may not necessarily follow, but the hydraulic may increase the time is takes for the jack element to adjust to the driving mechanism's rpm change.

Figure 3:
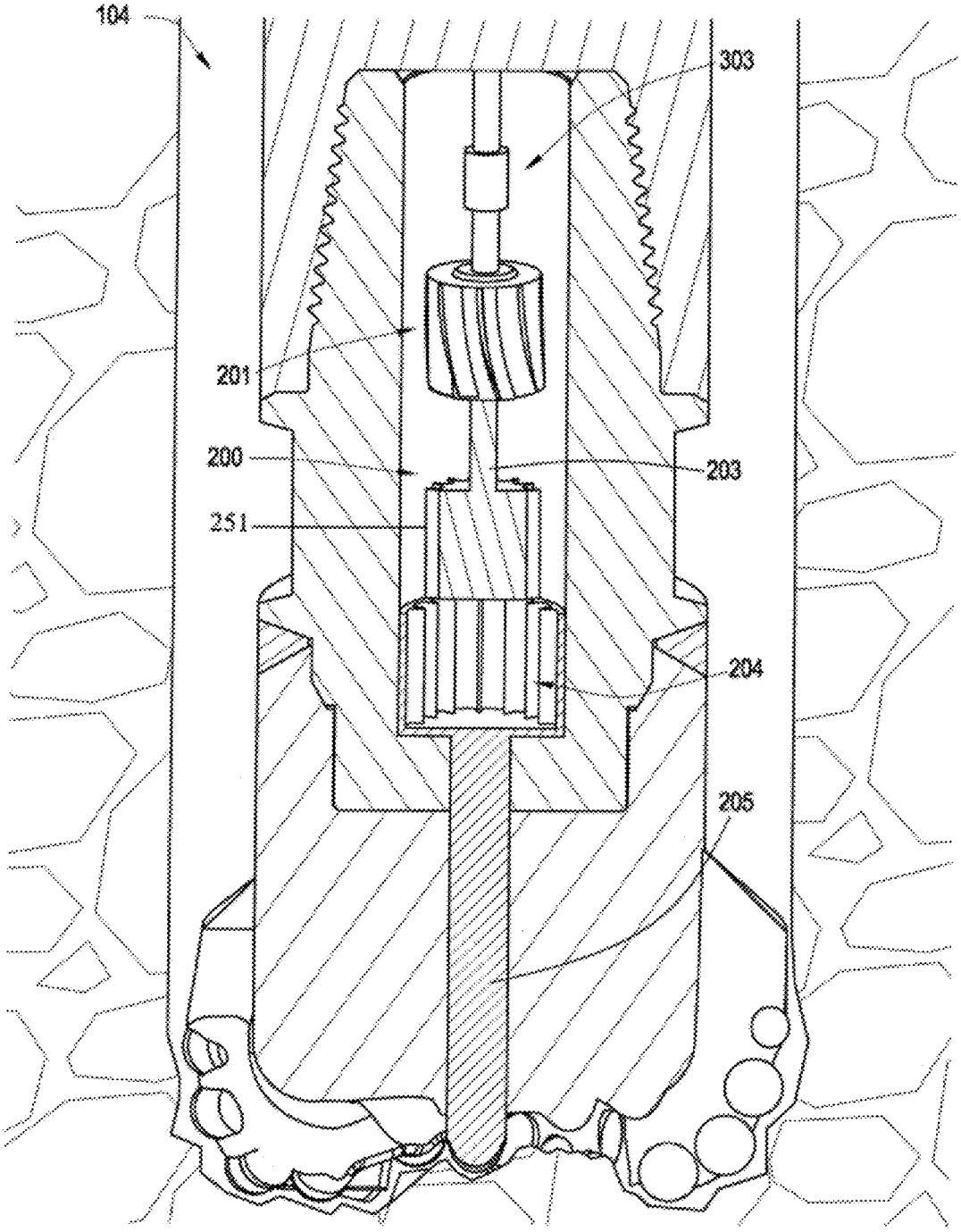
FIG. 3 is a cross-sectional diagram of an embodiment of a drill bit with a clutch assembly.

FIG. 3 is a cross-sectional diagram of a drill bit 104 comprising another embodiment of a clutch assembly 200. In this embodiment, the inner coupler 251 is attached to a driving mechanism 201 such as a turbine and the outer coupler 204 is attached to the jack element 205. The driving mechanism 201 may also be an electric or hydraulic motor. The driving mechanism 201 may be in communication with an accelerometer 303 that may be able to measure rotational speed. The clutch assembly 200 may be able to move by way of a hydraulic ram system 400 which will be described with reference to FIG. 4.

Figure 4:
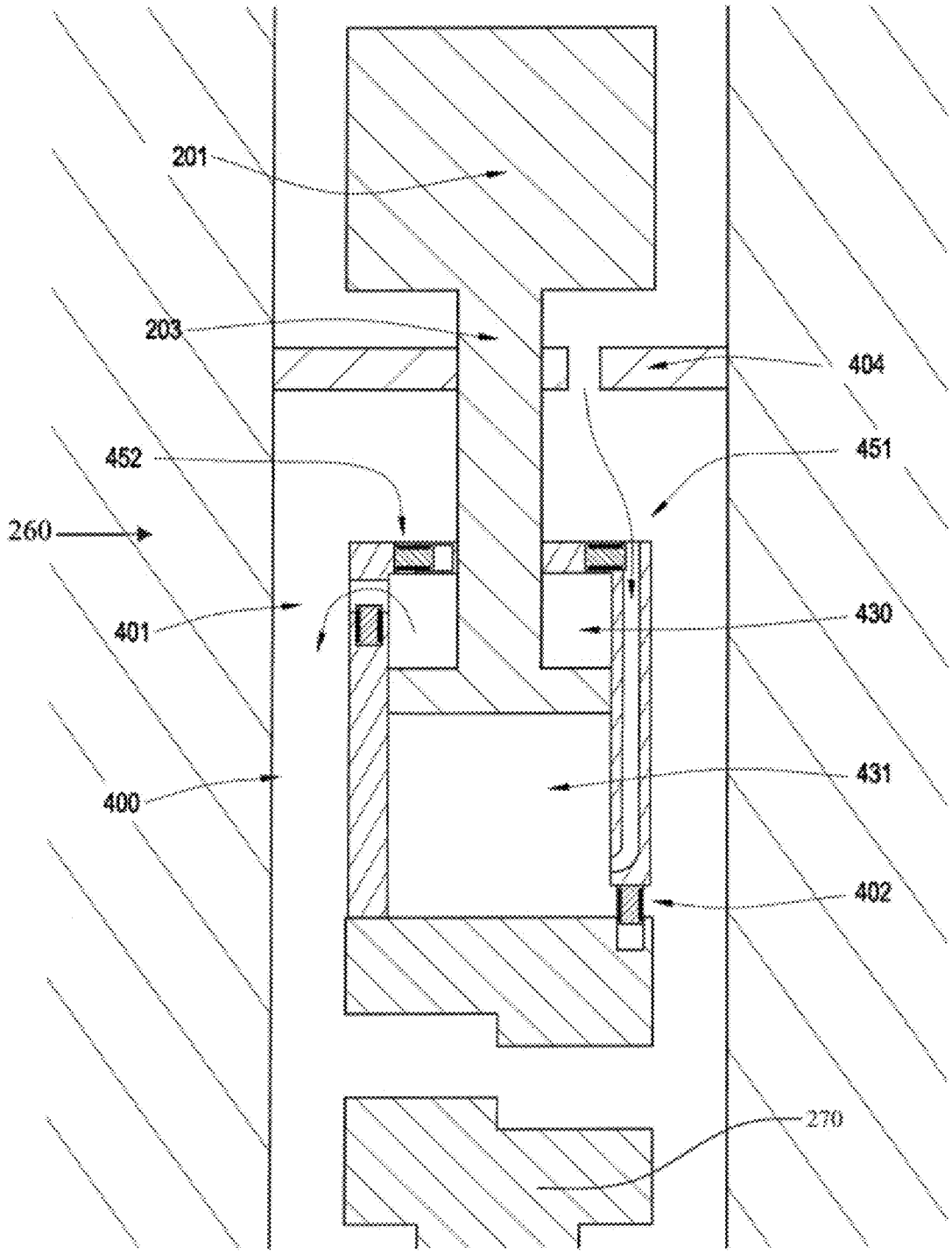
FIG. 4 is a cross-sectional diagram of an embodiment of a clutch assembly comprising a hydraulic ram system.

FIG. 4 is a cross-sectional diagram of a clutch assembly 260 comprising a hydraulic ram system 400 which may allow a portion of the clutch assembly to telescopically move. The hydraulic ram system 400 may comprise entry valves 451 and 452 with exit valves 401 and 402 that allow fluid to enter and exit the system. The valves may comprise a latch, hydraulics, a magnetorheological fluid, electrorheological fluid, a magnet, a piezoelectric material, a magnetostrictive material, a piston, a sleeve, a spring, a solenoid as shown in FIG. 4, a ferromagnetic shape memory alloy, or combinations thereof. When valve 452 and 402 are open and valve 401 is closed, drilling mud may pass through an opening leading to an upper chamber 430. When entry valve 451 and 401 are open and exit valve 402 is closed drilling mud may pass through to a lower chamber 431.

The driving mechanism 201 may be supported by a flange 404 attached to the drill bit 102 with openings that allow for fluid to pass through. The jack element 205 may be supported by being placed within an opening within the drill bit 102.

In some embodiments such as FIG. 4 the jack element 270 comprises a step geometry that allows for engagement with an end of the clutch assembly.

FIG. 5 is a cross-sectional diagram of a drill bit 490 comprising another embodiment of a clutch assembly 200. In this particular embodiment the clutch assembly 200 comprises a telescoping end 500. The second end of the clutch assembly 450 may telescope toward and interlock with an interlocking geometry 501 of the jack element 510. The jack element 510 may be held in place by a ring attached 404 to the drill bit 102. The flange may comprise openings that allow fluid to pass through. The jack element 510 at a controllable rotational speed is believed to assist in aiding the sensitive electronic components 503 within the tool bore. These electronic components may comprise sensors, gyros, magnometers, acoustic sensors, piezoelectric devices, magnetostrictive devices, MEMS gyros, or combinations thereof.

Figure 6:
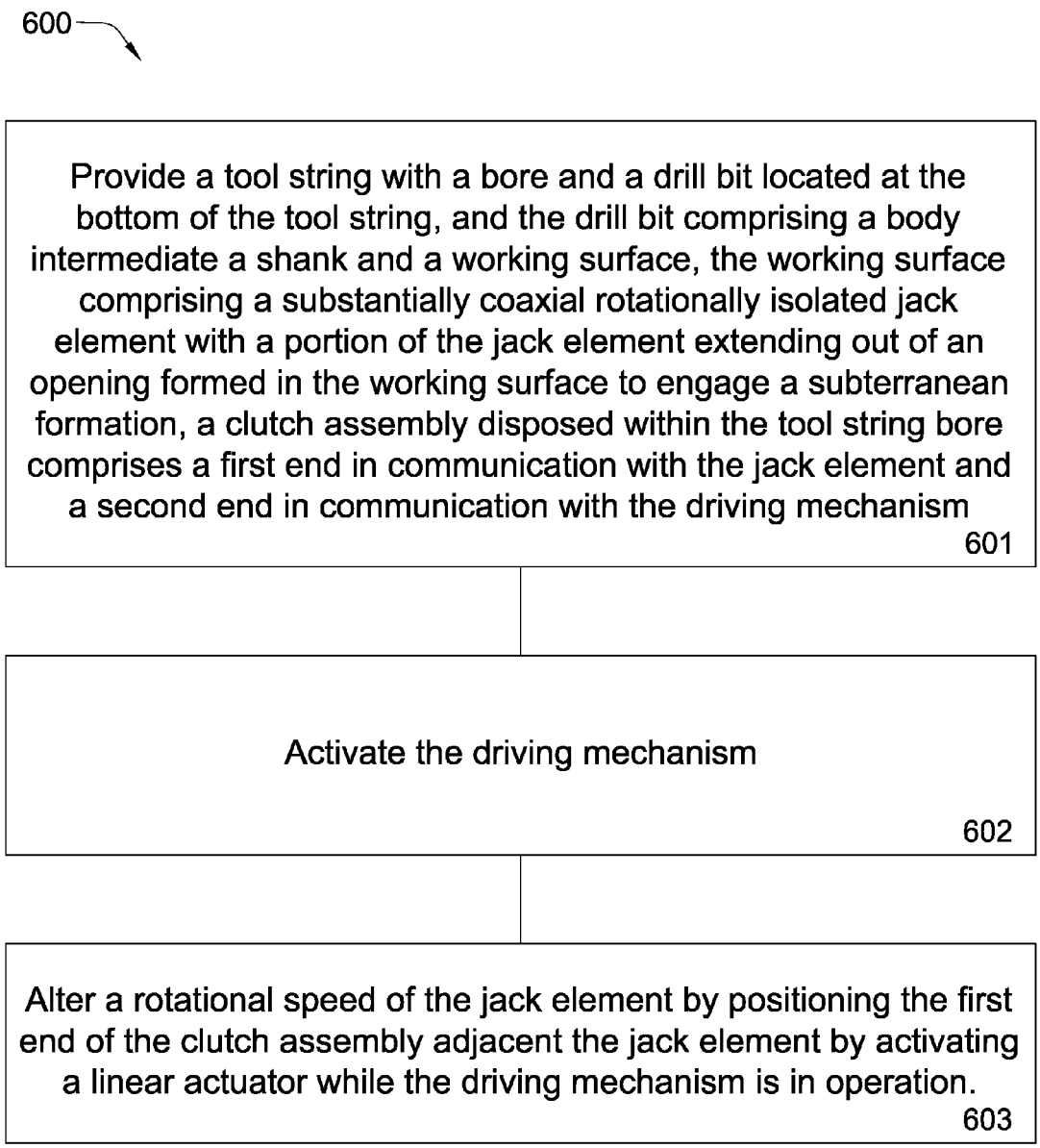
FIG. 6 is a flowchart illustrating an embodiment of a method for controlling a jack element within a drill bit.

FIG. 6 is a flowchart illustrating an embodiment of a method 600 for controlling a jack element 205 within a drill bit 102. The method 600 includes the step 601 of providing a tool string 100 with a bore and a drill bit 102 located at the bottom of the tool string 100. The drill bit 102 may comprise a body intermediate a shank and a working surface. The working surface may comprise a substantially coaxial rotationally isolated jack element 205 with a portion of the jack element 205 extending out of an opening formed in the working surface to engage a subterranean formation. The clutch assembly 200 disposed within the tool string 100 bore may comprise a first end in communication with the jack element 205 and a second end in communication with the driving mechanism. The driving mechanism is then activated 602; and the rotational speed of the jack element 205 altered 603.

Whereas the present invention has been described in particular relation to the drawings attached hereto, it should be understood that other and further modifications apart from those shown or suggested herein, may be made within the scope and spirit of the present invention.

What is claimed is:

1. A downhole assembly for use in drilling a subterranean formation, the downhole assembly comprising:

a tool string having a bore therethrough, the tool string including:

a drill bit that includes:

a shank;

a working surface;

a body between the shank and the working surface; and, a jack element in which at least a portion of the jack element extends beyond the working surface;

a driving mechanism adapted to rotate the jack element relative to the drill bit and, a clutch assembly that includes:

an inner coupler connected to the jack element;

a first outer coupler; and, a second outer coupler rigidly connected to one of the tool string and the drill bit.

2. The downhole assembly of claim 1, wherein the clutch assembly further comprises a housing having a first end connected to the driving mechanism, the first housing further being connected to the first outer coupler, the clutch assembly selectively positioning the inner coupler (a) clear of both the first outer coupler and the second outer coupler and (b) interlocking with at least one of the first outer coupler and the second outer coupler.

3. The downhole assembly of claim 2, wherein the clutch assembly further comprises a linear actuator connected to the jack element.

4. The downhole assembly of claim 3, wherein the clutch assembly is in mechanical or hydraulic communication with at least one of the jack element and the driving mechanism.

5. The downhole assembly of claim 3, wherein the driving mechanism is disposed within the bore of the tool string.

6. The downhole assembly of claim 5, wherein the driving mechanism is selected from the group consisting of a turbine, an electric motor, and a hydraulic motor.

7. The downhole assembly of claim 2, wherein the housing includes openings adapted to allow a fluid to pass therethrough.

8. The downhole assembly of claim 1, wherein at least one electronic component is rotationally fixed to the jack element.

9. The downhole assembly of claim 8, wherein the electronic component includes at least one of comprise sensors, gyros, magnometers, acoustic sensors, piezoelectric devices, magnetostrictive devices, and MEMS gyros.

10. The downhole assembly of claim 1, wherein the bore of the tool string comprises an accelerometer in communication with the jack element.

11. The downhole assembly of claim 1, wherein the first outer coupler is adapted to rotate counter the drill bit, with the drill, or both.

12. The downhole assembly of claim 11, wherein the first outer coupler is adapted to rotate by means of a passing fluid.

13. The downhole assembly of claim 2, wherein the first end of the clutch assembly comprises geometry adapted to engaged the driving mechanism, the geometry comprising at least one of a flat geometry, a cone geometry, an irregular geometry, a geometry with at least one recess, and a geometry with at least one protrusion.

14. A drill bit assembly for use in drilling a subterranean formation, the drill bit assembly comprising:

a drill bit that includes:

a shank;

a working surface;

a body between the shank and the working surface; and, a jack element rotationally isolated from the body;

a driving mechanism adapted to rotate the jack element relative to the drill bit and, a clutch assembly that includes:

a housing having a first end connected to the driving mechanism;

an inner coupler connected to the jack element; and, a first outer coupler connected to the housing, the first outer coupler being adapted to rotate by means of a passing fluid; and, a linear actuator connected to the jack element and configured to engage the inner coupler with the first outer coupler.

15. The drill bit assembly of claim 14, wherein the clutch assembly further comprising a second outer coupler rigidly connected to the drill bit.

16. The drill bit assembly of claim 15, wherein the linear actuator selectively positions the inner coupler (a) clear of both the first outer coupler and the second outer coupler and (b) interlocking with at least one of the first outer coupler and the second outer coupler.

17. The drill bit assembly of claim 14, wherein at least a portion of the jack element extends beyond the working surface.

18. The drill bit assembly of claim 14, wherein the clutch assembly is in mechanical or hydraulic communication with at least one of the jack element and the driving mechanism.

19. The drill bit assembly of claim 14, wherein the driving mechanism is selected from the group consisting of a turbine, an electric motor, and a hydraulic motor.

20. The drill bit assembly of claim 14, wherein the first outer coupler is adapted to rotate counter the drill bit, with the drill, or both.

* * * * *